US005339743A

United States Patent [19]

Scarlata

[11] Patent Number: 5,339,743

[45] Date of Patent: Aug. 23, 1994

[54] AMMUNITION SYSTEM COMPRISING SLUG HOLDING SABOT AND SLUG TYPE SHOT SHELL

[75] Inventor: Vincent F. Scarlata, Cabot, Ak.

[73] Assignee: Remington Arms Company, Inc., Wilmington, Del.

[21] Appl. No.: 88,939

[22] Filed: Jul. 12, 1993

[51] Int. Cl.[5] ..... F42B 5/02; F42B 14/06

[52] U.S. Cl. ..... 102/439; 102/448; 102/509; 102/522

[58] Field of Search ..... 102/439, 448, 506–510, 102/520–523, 532

[56] References Cited

U.S. PATENT DOCUMENTS

| | | | |
|---|---|---|---|
| 219,840 | 9/1879 | Wincheser | 102/509 |
| 2,788,744 | 4/1957 | Donner | 102/522 |
| 3,058,420 | 10/1962 | Tanner et al. | 102/439 |
| 3,138,102 | 6/1964 | Meyer et al. | 102/439 |
| 3,507,221 | 4/1970 | Grolly | 102/523 |
| 4,776,279 | 10/1988 | Pejsa | 102/510 |
| 4,860,661 | 8/1989 | Bock et al. | 102/523 |
| 5,105,713 | 4/1992 | Wirgau | 102/522 |
| 5,214,238 | 5/1993 | Young | 102/520 |
| 5,235,915 | 8/1993 | Stevens | 102/439 |

FOREIGN PATENT DOCUMENTS

| | | | |
|---|---|---|---|
| 1808779 | 6/1970 | Fed. Rep. of Germany | 102/522 |
| 2343218 | 9/1977 | France | 102/520 |
| 1534004 | 7/1986 | France | 102/522 |
| 427344 | 9/1948 | Italy | 102/520 |

*Primary Examiner*—Harold J. Tudor
*Attorney, Agent, or Firm*—Donald W. Huntley

[57] ABSTRACT

An ammunition system having a sabot with spaced segments forming a cavity for receiving a slug, the segments have projections that interlock on a ledge on the slug. The sabot segments are undercut to facilitate the segments bending outwardly to release the slug when firing. The slug has a segmented hollow point nose and a boat tail base portion. The sabot and slug are used in a shell with a gas seal wad and an alignment disc.

4 Claims, 2 Drawing Sheets

AMMUNITION SYSTEM COMPRISING SLUG HOLDING SABOT AND SLUG TYPE SHOT SHELL

BACKGROUND OF THE INVENTION

1. Field of the Invention

This invention relates to an ammunition system having a sabot and slug used in a slug type shot shell.

2. Summary of the Prior Art

It is well known in the field of ballistics that as a projectile passes through a gun bore at high speed, the friction and resulting heat causes the barrel to erode or wear which results in ineffective gas sealing and loss of projectile velocity and true flight. Various designs of sabots have been developed to hold the projectile and reduce gun bore wear.

U.S. Pat. No. 3,164,092 discloses a sabot that has weakened grooves so that the sabot segments can separate when released from the gun barrel. U.S. Pat. No. 4,829,904 discloses a sabot for holding a cross shaped projectile. U.S. Pat. No. 3,769,912 discloses a sabot attached to the projectile. U.S. Pat. Nos. 4,676,169 and 4,860,661 disclose still other forms of sabots for a projectile.

SUMMARY OF THE INVENTION

The cylindrical sabot and slug of this invention have a mechanical interlock, with the sabot having a base portion and upstanding spaced segments terminating in peripheral edges equidistant from the base and forming an opening for receipt of the slug. The sabot segments have locking projections spaced from the peripheral edge that interlock with a retaining ledge on the slug. The retaining ledge and the locking projections each have a surface which is substantially perpendicular to the longitudinal axis of the saboted projectile. The segments are sloped outwardly from the locking projections to the peripheral edge to permit wind resistance to force the segments to pivot outwardly from the base as the sabot exits the gun barrel, thus releasing the slug.

Additionally, the sabot segments are undercut in the area adjacent the sabot base to facilitate pivoting the sabot segments outwardly to release the slug.

The sabot and slug are loaded into a shotgun shell that has a chamber for propellant; a low density polyethylene gas seal wad that traps and contains expanding gas behind a disc, the sabot and slug when the shell is fired; an engineered thermoplastic resin disc which supports the gas seal wad and aligns the sabot and slug as it is forced down the barrel by the expanding gas; a one piece sabot that is slightly larger in diameter than the barrel bore diameter so the sabot grips the slug securely so the rifled bore can spin the sabot and slug; and a slug that is hollow point with four spaced front sections that separate to provide an effective wound channel. The sabot is made from an engineered thermoplastic resin.

DESCRIPTION OF THE PREFERRED EMBODIMENT

Figure 2:
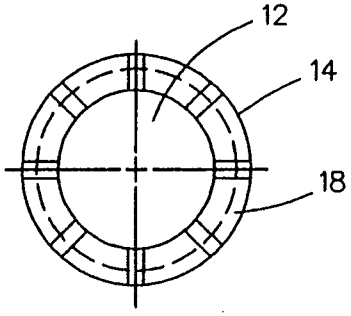
FIG. 2 is a top plan view of the sabot.
Figure 1:
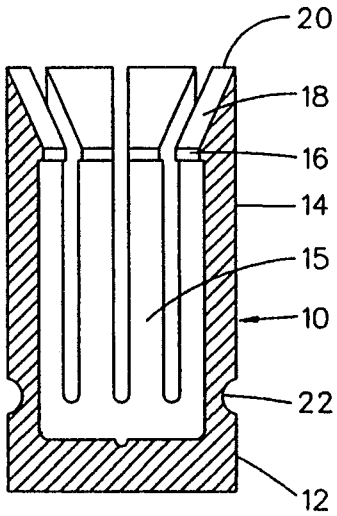
FIG. 1 is a sectional view of the sabot of this invention.

Attention is now directed to FIGS. 1 and 2 which illustrate the cylindrical sabot 10 having a base portion 12 and spaced segments 14 extending outwardly from the base portion and forming a cylindrical cavity 15. The segments each have locking projections 16 from which the segments are sloped outwardly at 18 to a peripheral edge 20. Each of the segments 14 are undercut at 22 adjacent the base 12 to facilitate the segments bending outwardly to release the slug, as will become more apparent hereinafter.

Figure 4:
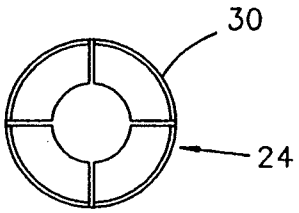
FIG. 4 is a top plan view of the slug.
Figure 3:
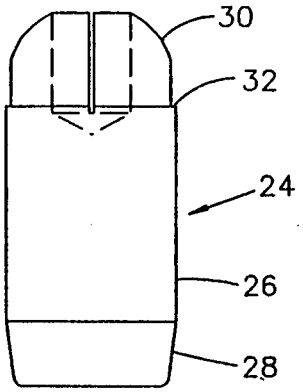
FIG. 3 is a side view of the slug.

FIGS. 3 and 4 illustrate the copper slug 24 having a main cylindrical body portion 26, a boat tail base portion 28 and segmented split hollow point nose 30. The body portion 26 extends to a locking ledge 32 onto which the projections 16 interengage when the slug is inserted into the sabot cavity 15 (see FIG. 5). The boat tail base portion 28 facilitates inserting the slug down the sloped surfaces 18 and into the sabot 10. Further, as illustrated in FIG. 5, the boat tail portion is spaced from the segments so that the slug fits in alignment with the sabot so the slug cannot be cocked or misaligned within the sabot when assembled.

Figure 5:
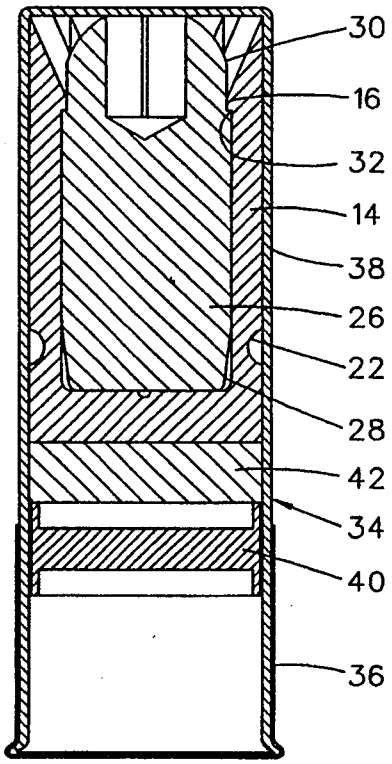
FIG. 5 is a sectional view of the shotgun shell.

Reference is now made to FIG. 5 which illustrates the sabot and slug assembled in the shotgun shell 34. The shell 34 has a base 36 for containing the propellant and a body portion 38 containing low density polyethylene gas seal wad 40, an engineered thermoplastic resin disc 42 and the sabot and slug. The wad 40 traps and contains the expanding gas behind the disc 42, sabot and slug when the shell is fired. The disc 42 supports the gas seal wad 40 and aligns the sabot and slug as they are forced down the gun barrel by the expanding gas.

Figure 6:
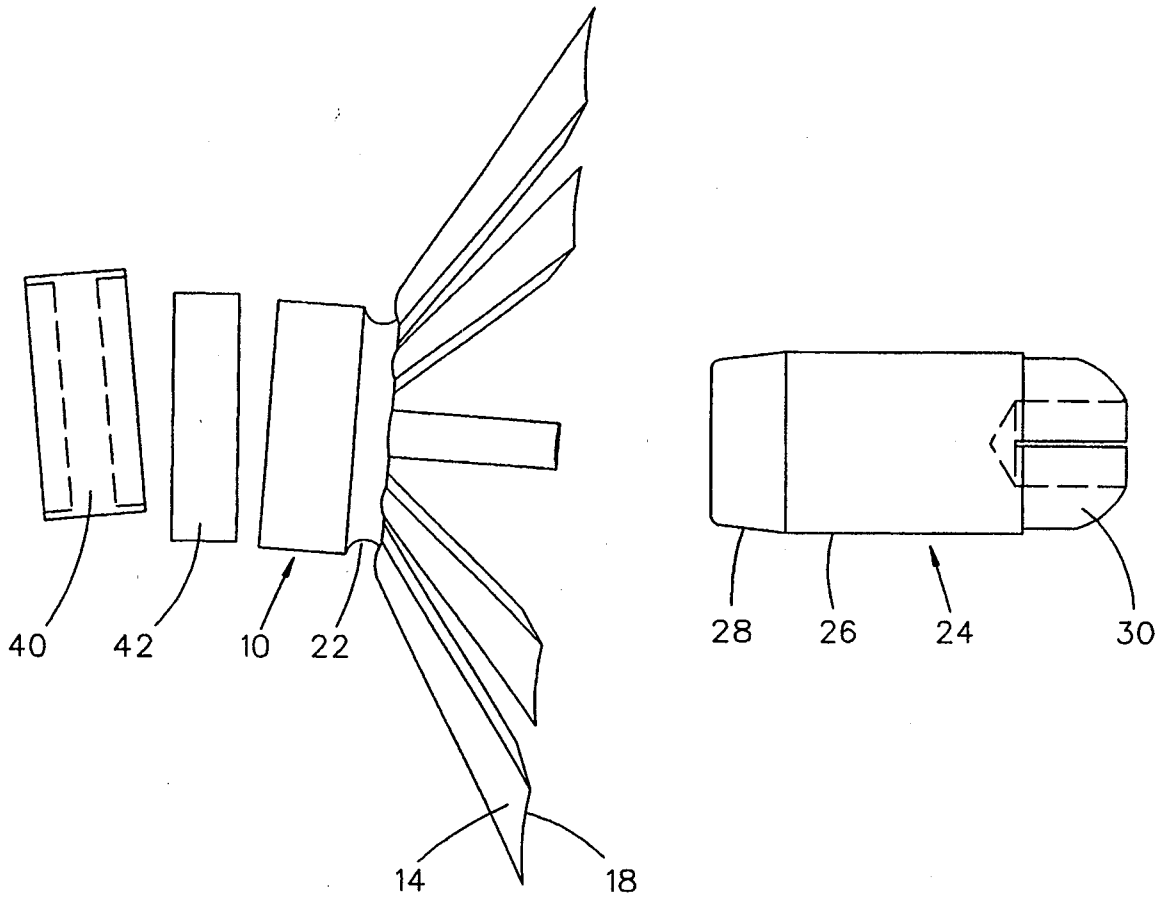
FIG. 6 is an illustration of the interaction of the gas seal wad, disc, sabot and slug as they pass from the barrel bore.

FIG. 6 illustrates how the wad 40, disc 42, sabot 10 and slug 24 separate upon leaving the gun barrel. The wind resistance causes the sabot segments 14 to pivot about the undercut relieved area 22 releasing the slug. The wad, disc and sabot tumble to the ground and the spinning slug proceeds to the target. The slug segments pivot outwardly about the locking ledge area 32 and actually separate from the slug main body portion 26 so that there are five slug pieces passing through the target for maximum trauma to the target. To obtain optimum accuracy, the following must be present.

A. The slug must receive the full rotation that is available from the rifled barrel. As only the sabot comes in contact with the barrel, it must transfer its rotation to the slug. This is accomplished by the friction between that sabot and slug as they travel down the gun barrel. The sabot diameter is made larger than barrel groove diameter and when forced down the barrel, the I.D. of the sabot decreases to hold the slug and transfer the rotation of the sabot to the slug. The design of the slug and sabot must be such that there is no slippage between the sabot and rifled barrel, and the sabot and the copper slug.

B. Before and after firing, the slug must be a slip fit in the sabot. To retain the slug within the sabot but not degrade accuracy, it was found that the sabot must securely hold the slug, but allow unrestrained release when the sabot and slug cleared the barrel.

It can be seen from the drawings that the slug is held by the sabot and cannot be released until the sabot starts to open. This is accomplished by the shape of the front of the sabot, which snaps over a ledge on the front of the slug or its profile. When the slug is fed into the sabot, the spring of its fingers allows the slug to be inserted and then snaps into place over the ledge or profile of the slug. The spring of the finger holds the slug in place, although the slug is a slip fit in the sabot. When the slug and sabot are fed into a shotshell, the relationship between O.D. of the sabot and the I.D. of the shotshell prevents the fingers from opening enough to allow the release of the slug under even the most severe conditions, like those encountered in the magazine tube of a shotgun. As the slug and sabot travel down the gun barrel, again the relationship of the O.D. of the sabot and the I.D. of the barrel prevent the sabot from opening.

When the slug and sabot leave the barrel, the sabot begins to open almost immediately, and with very little movement of the fingers of the sabot, the slug is no longer secured in the sabot. The sabot is discarded two to three feet from the muzzle of the gun barrel, and being a slip fit on the slug, has no effect on the accuracy potential of the slug.

C. The sabot must not influence the slug after firing. This is accomplished by "B" above and by designing the sabot such that it comes away from the slug in a very rapid and consistent manner. This is accomplished by an undercut 22 in the sabot that allows rapid and consistent opening of the eight segments when releasing the slug. To ensure no influence between the slug and sabot after firing, a 11° 24′ boat tail is machined on the end of the slug to allow up to a 10° sabot tilt before contact can be made (see FIG. 6).

The slug is designed to become unstable after limited travel. When this happens, the slug will tumble, and thus drastically reduce its extreme range. This is accomplished by the relationship of the slug diameter, length, ballistic coefficient, sectional density and velocity.

The slug is a controlled, expanding, separating design made from solid C145 copper. The slug is designed so after limited penetration, the four front sections expand to over 2× diameter, separate and continue forward in a conical direction while the main section approximately 80% of the original weight, continues in its original direction for deep penetration. With the separation of the four front sections, the frontal shape of the main section is approximately 1.15× diameter, with a shallow cupped configuration that has many cutting edges that produce a very effective wound channel. The four separated front sections produce a conical shaped, permanent disruptive wound of a lesser length, but of much greater diameter than the main section.

I claim:

1. A shot shell ammunition system including:

(a) a cylindrical sabot having a base portion with upwardly extending spaced flexible segments forming a cylindrical cavity, with the segments locking projections extending inwardly toward the cavity and being undercut in the base portion; and (b) a slug located within the cylindrical cavity of the sabot having a main cylindrical body portion terminating in an annular locking ledge having a surface substantially perpendicular to a longitudinal axis of the cylindrical body portion, the locking ledge being substantially the same distance from the base of the cylindrical body portion as the locking projections are from the interior base of the sabot to the locking projections, each locking projection having a surface substantially perpendicular to a longitudinal axis of the sabot to mate with the locking ledge, the locking projections on the sabot segments, when the slug is inserted into the sabot cavity, passing over the slug locking ledge to axially retain the slug in the sabot, the slug having a hollow point segmented nose portion.

2. The ammunition system of claim 1 wherein said sabot segments have sloped surfaces extending from the area of the prjections to an outer peripheral surface.

3. The ammunition system of claim 1 wherein said slug has a boat tail base portion.

4. The ammunition system of claim 1 including a shot shell for receiving said slug and sabot with the shot shell having a gas seal wad and aligment disc, the slug and the sabot being located in from of the gas seal wad and alignment disc.

* * * * *